US009697942B2

(12) United States Patent
Buhler

(10) Patent No.: US 9,697,942 B2
(45) Date of Patent: Jul. 4, 2017

(54) ELECTROMAGNET

(71) Applicant: Festo AG & Co. KG, Esslingen (DE)

(72) Inventor: Andreas Buhler, Stuttgart (DE)

(73) Assignee: FESTO AG & CO. KG, Esslingen (DE)

( * ) Notice: Subject to any disclaimer, the term of this patent is extended or adjusted under 35 U.S.C. 154(b) by 0 days.

(21) Appl. No.: 15/302,336

(22) PCT Filed: Mar. 31, 2015

(86) PCT No.: PCT/EP2015/056947
§ 371 (c)(1),
(2) Date: Oct. 6, 2016

(87) PCT Pub. No.: WO2015/155052
PCT Pub. Date: Oct. 15, 2015

(65) Prior Publication Data

US 2017/0025211 A1 Jan. 26, 2017

(30) Foreign Application Priority Data

Apr. 11, 2014 (DE) ..... 10 2014 005 437

(51) Int. Cl.

| | |
|---|---|
| ***H01F 5/02*** | (2006.01) |
| ***H01F 7/20*** | (2006.01) |
| ***H01F 27/32*** | (2006.01) |
| ***H01F 7/06*** | (2006.01) |
| *H01H 50/44* | (2006.01) |
| *H01F 3/02* | (2006.01) |
| *H01F 7/16* | (2006.01) |

(52) U.S. Cl.
CPC ..... *H01F 7/20* (2013.01); *H01F 5/02* (2013.01); *H01F 7/06* (2013.01); *H01F 27/325* (2013.01); *H01F 3/02* (2013.01); *H01F 7/1638* (2013.01); *H01H 2050/446* (2013.01)

(58) Field of Classification Search
CPC .... H01F 5/02; H01F 27/325; H01H 2050/446
See application file for complete search history.

(56) References Cited

U.S. PATENT DOCUMENTS 5,034,716 A 7/1991 Mokadam

FOREIGN PATENT DOCUMENTS

| | | |
|---|---|---|
| AT | 237149 | 11/1964 |
| CH | 134181 | 9/1929 |
| DE | 728288 | 11/1942 |
| DE | 1076806 | 3/1960 |
| DE | 2526150 | 12/1976 |

(Continued)

*Primary Examiner* — Ramon M Barrera
(74) *Attorney, Agent, or Firm* — Hoffmann & Baron, LLP

(57) ABSTRACT

An electromagnet including a wire coil and a coil core, wherein the wire coil is accommodated on a coil body and includes a plurality of windings which surround the coil core and define a winding axis, wherein the coil body includes end pieces spaced apart along the winding axis and axially bounding the wire coil, which end pieces are connected to each other by at least two connecting webs extending along the winding axis and defining, together with a recess in at least one of the end pieces, an accommodating space for the coil core which is bounded by a rectangular envelope having at least one profile protruding inwards in a cross-sectional plane oriented perpendicular to the winding axis, and wherein the coil core has a recess which extends along the winding axis in at least some sections and which corresponds to the profile.

7 Claims, 5 Drawing Sheets

(56) References Cited

FOREIGN PATENT DOCUMENTS

| | | |
|---|---|---|
| DE | 2627314 | 12/1977 |
| DE | 2931362 | 2/1981 |
| DE | 4203199 | 8/1993 |
| DE | 102006019296 | 10/2007 |
| DE | 202011102342 | 9/2011 |
| DE | 102011079667 | 1/2013 |
| DE | 102012205116 | 10/2013 |
| EP | 2284859 | 2/2011 |
| FR | 2388384 | 11/1978 |
| JP | S52147250 | 11/1977 |

ELECTROMAGNET

This application claims priority based on an International Application filed under the Patent Cooperation Treaty, PCT/EP2015/056947, filed Mar. 31, 2015, which claims priority to DE102014005437.3, filed Apr. 11, 2014.

BACKGROUND OF THE INVENTION

The invention relates to an electromagnet comprising at least one wire coil and at least one coil core, wherein the at least one wire coil is accommodated on a coil body and comprises a plurality of windings which surround the at least one coil core and define a winding axis, wherein the at least one coil body comprises end pieces spaced apart along the winding axis and axially bounding the at least one wire coil, which end pieces are connected to each other by at least two connecting webs extending along the winding axis and defining, together with a recess in at least one of the end pieces, an accommodating space for the coil core.

From EP 2 284 859 A1, an electromagnet for use in a relay is known, wherein a coil body is provided with flange sections at the ends for bounding a coil, and wherein windings of a coil surround an iron core provided with an end-side flange section. The coil body and the iron core are matched to one another in such a way that the iron core projects beyond the core body with its end regions, wherein an end of the iron core can be gripped by a winding machine to produce the coil. The flange sections of the coil body are further mechanically connected to one another by two connecting webs.

SUMMARY OF THE INVENTION

The invention is based on the problem of providing an electromagnet which ensures simple assembly and a high degree of operational reliability.

For an electromagnet of the type referred to above, this problem is solved by an electromagnet comprising at least one wire coil and at least one coil core, wherein the at least one wire coil is accommodated on a coil body and comprises a plurality of windings which surround the at least one coil core and define a winding axis, wherein the at least one coil body comprises end pieces spaced apart along the winding axis and axially bounding the at least one wire coil, which end pieces are connected to each other by at least two connecting webs extending along the winding axis and defining, together with a recess in at least one of the end pieces, an accommodating space for the coil core, wherein the accommodating space is bounded by a rectangular envelope having at least one profile protruding inwards in a cross-sectional plane oriented perpendicular to the winding axis, and that the at least one coil core has a recess which extends along the winding axis in at least some sections and which corresponds to the profile.

The accommodating space is preferably bounded only partially by the connecting webs and the at least one end piece provided with a recess and moreover has regions which are not bounded by the coil body in order to provide a compact design of the electromagnet. Accordingly, in these regions a direct contact is possible between the windings of the wire coil, which may, for example, be windings of a copper-enamelled wire, and the coil core, which is typically made of an electrically conductive, preferably ferritic, material. In order to ensure the desired simple assembly accompanied by a high degree of operational reliability for the electromagnet, an adequate safety gap has to be provided in those regions where a direct contact between the wire coil and the coil core is possible. In order to ensure a compact design for the electromagnet irrespective of this safety gap, the coil body and the coil core are matched to one another by means of the profiles and the corresponding recesses in such a way that a secure guidance for the coil core is ensured while it is being installed into the accommodating space of the coil body. As a result, there is, irrespective of a small safety gap between the coil core and the windings of the wire coil, no risk that these windings could be touched in the assembly process and an insulating layer on the windings, in particular a coating layer, could be damaged. In this way, the profile in the accommodating space of the coil body and the corresponding recess in the coil core provide an advantageous guidance while the coil core is inserted into the coil body. The profile in the accommodating space of the coil body can extend along the winding axis in some sections or else along the entire length of the winding axis. The recess in the coil core has to be designed such that it facilitates an insertion of the coil core into the accommodating space. Depending on the design of the profile on the coil body, the recess on the coil core therefore optionally extends either over a part-section of the winding axis or along the whole winding axis over the length of the coil body towards the winding axis.

Advantageous further developments of the invention are specified in the dependent claims.

It is expedient if the profile is formed on a surface of the connecting piece which is opposite the at least one coil core. This ensures the guidance for the installation of the coil core into the coil body in a particularly advantageous way. The profile preferably extends along the entire dimension of the connecting web towards the winding axis. Alternatively, it can be provided that the profile is interrupted in sections, in order to save material and weight at least in the case of larger coil bodies. As a rule, however, the profile will extend at least almost completely along the winding axis on the connecting piece. In a particularly preferred embodiment, the profiles and the recesses are arranged mirror-symmetrically relative to a mirror plane including the winding axis.

It is advantageous if the profile is formed on a surface of the recess of the end piece which lies opposite the at least one coil core. In this way, the desired guidance of the coil core by the interaction between profile and recess is ensured in advance at the start of the assembly process while the coil core is being inserted into the coil body. It is particularly advantageous if the profile in the recess of the end piece is adjoined by a profile on that surface of the connecting piece which is opposite the coil core, whereby a particularly secure guidance of the coil core can be ensured.

In an advantageous further development of the invention, it is provided that precisely two connecting webs, which form opposite side surfaces of the accommodating space, are located between the end pieces. With the two connecting webs, a dimensionally stable design of the coil body can be obtained while using little material. The connecting webs are preferably oriented symmetrically relative to the winding axis and substantially plate-shaped in design.

In a further variant of the invention, it is provided that each connecting web comprises two edge regions which extend along the winding axis, each of which is provided with a profile and located in corner regions of the envelope. As a result of the fact that the profiles are arranged in the edge regions of the connecting webs, which are located in the corner regions of the envelope, the profiles form an edge protection. In the corner regions, which are particularly critical in any case, this edge protection ensures a reliable distance between the windings of the wire coil and the coil core, thereby ensuring the desired high degree of operational reliability and easy assembly. Although a cross-section of the coil core is reduced in a cross-sectional plane oriented perpendicular to the winding axis by the recesses required for accommodating the profiles on the coil body, this nominal disadvantage for the conductance properties of the coil core is at least substantially compensated for or preferably overcompensated by the reduced safety gaps between the wire coil and the coil core, which can be reduced thanks to the protective action of the profile.

In an alternative embodiment of the core body, it is provided that precisely four connecting webs are formed between the end pieces, each of the connecting webs being designed as a profile and located in corner regions of the rectangular envelope. Such a design of the coil body provides for minimum material use in the production of the coil body without having to do without the edge protection for the windings of the wire coil.

In an advantageous further development, it is provided that at least one profile has a cross-section which varies along the winding axis. It is preferably provided that the profile is most distinct in a central region of the coil body, thus protruding to the largest degree into the accommodating space, and flattened towards the end pieces. This in particular arcuate shape for the at least one profile along the winding axis results, as the core body is placed on a for example cuboid winding mandrel, in a deformation of the coil body in a radial direction perpendicular to the winding axis. In the central region of the coil body, where the connecting webs have their greatest elasticity, the coil body and the wire coil to be wound thereon are therefore domed to a minor degree as a result of the profile. Following the removal of the coil body, there is therefore in this region a slightly reduced internal tension of the wire coil, so that the connecting webs are loaded less heavily in this region than in the region near the end pieces, where the connecting webs are more rigid.

In an advantageous further development, it is provided that the coil core is formed from a plurality of mutually parallel sheet metal layers, and that the recesses are designed as recesses or offsets on the sheet metal layers. By the design of the coil core from a plurality of sheet metal layers, eddy currents in the coil core are to be avoided, thus improving its flux characteristics for the magnetic field to be conducted. In addition, the individual sheet metal layers can be designed in their geometry in such a way that the required recesses are formed by the layering of the sheet metal layers without requiring any additional machining of the coil core.

BRIEF DESCRIPTION OF THE DRAWINGS

Advantageous embodiments of the invention are shown in the drawing, of which.

DETAILED DESCRIPTION OF THE PREFERRED EMBODIMENTS

Figure 1:
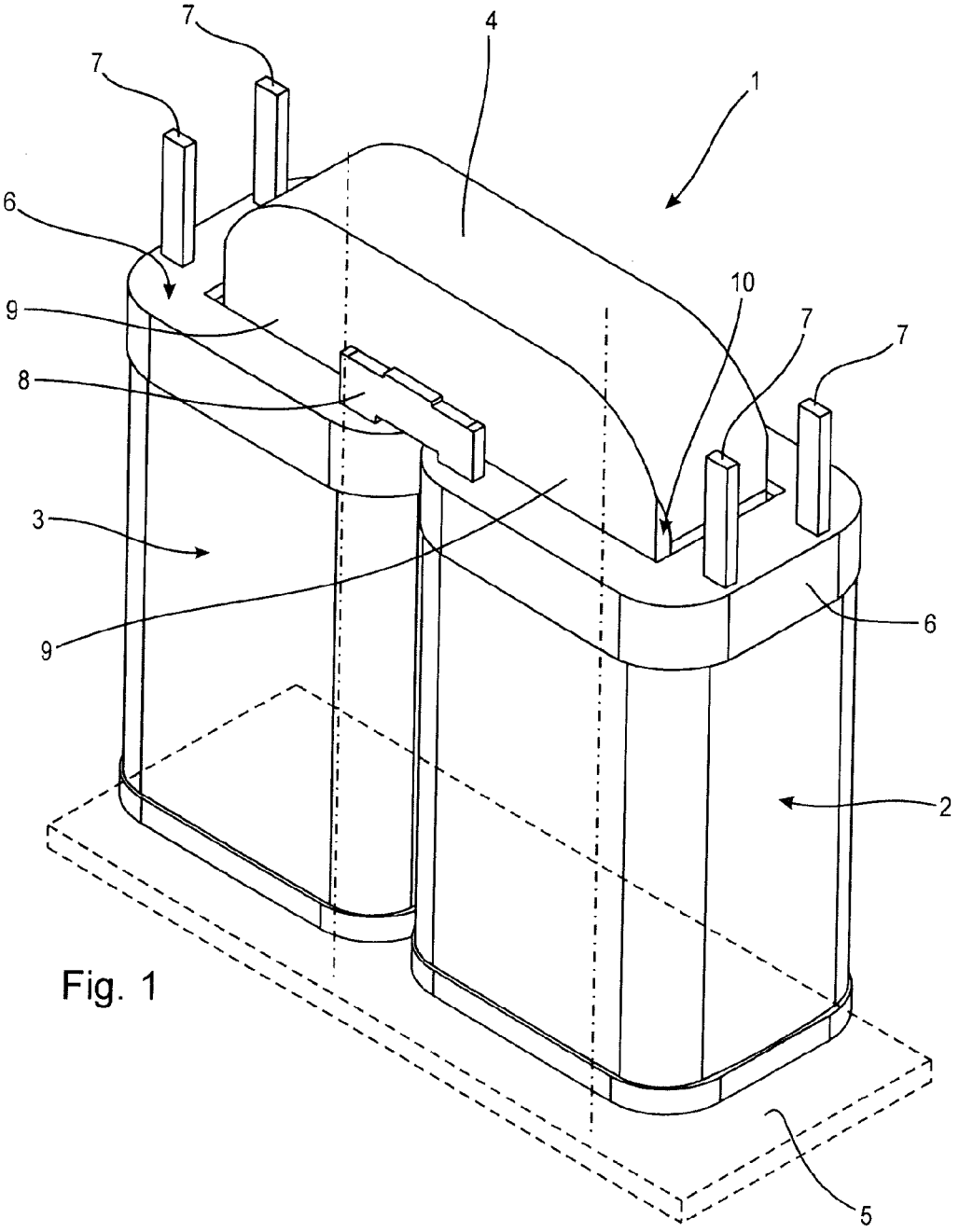
FIG. 1 is a perspective view of an electromagnet with two wire coils.

By way of example, an electromagnet 1 shown in FIG. 1 is designed as an assembly of two wire coils 2, 3 on a common coil core 4, which is U-shaped by way of example. If an electric current is applied to the wire coils 2, 3, the electromagnet 1 provides a magnetic field which can, for example, be used to move an armature plate 5 indicated by broken lines from an inoperative position distanced from the electromagnet 1 into a functional position close to the electromagnet 1. The armature plate 5 may, for example, be coupled to a valve body of a fluid valve not shown in detail, in order to lift this valve body off a valve seat in a valve housing, thereby facilitating a fluid flow from an inlet port of the valve housing past the valve seat to an outlet port of the valve housing.

Figure 3:
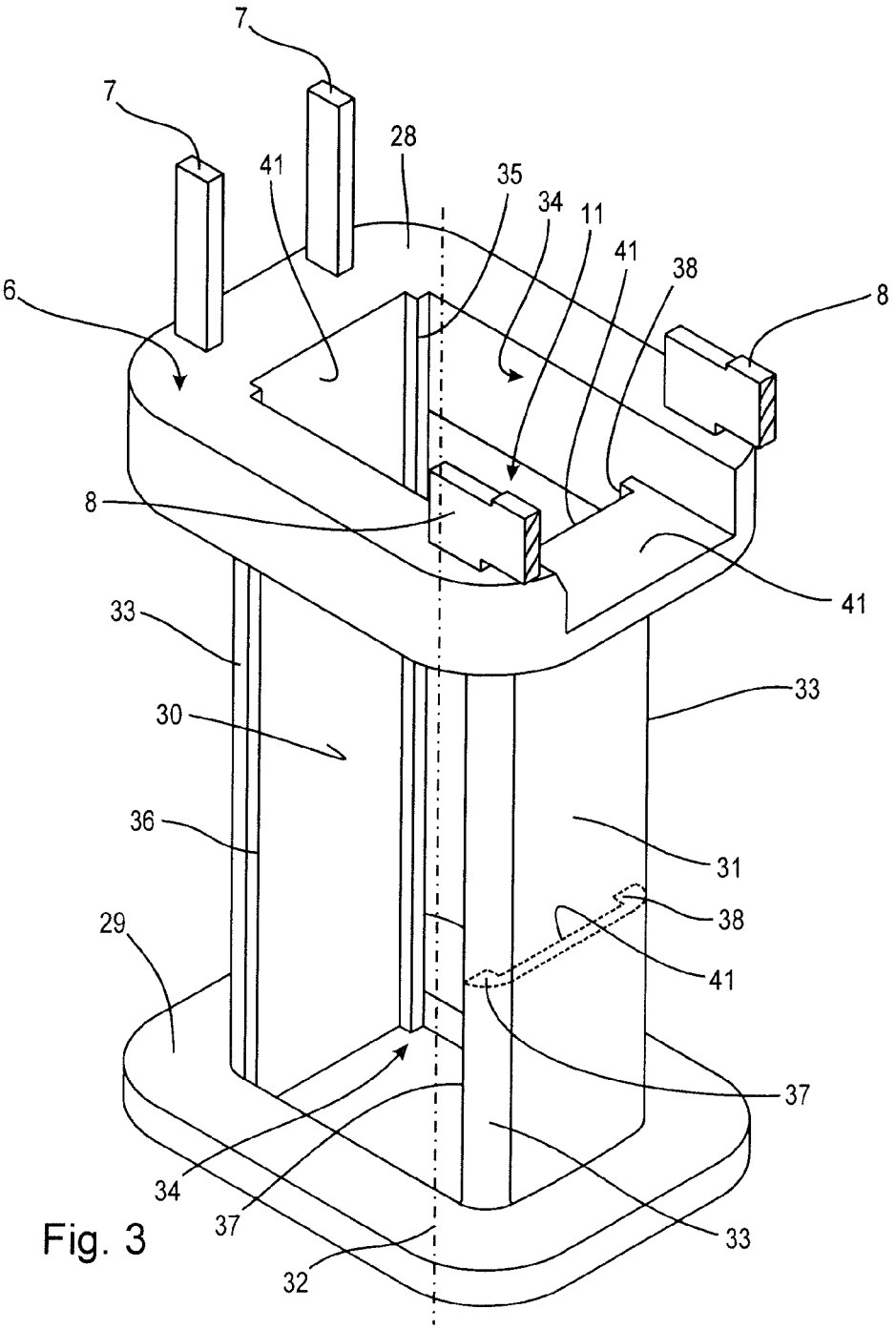
FIG. 3 is a perspective view of a first embodiment of a coil body.
Figure 4:
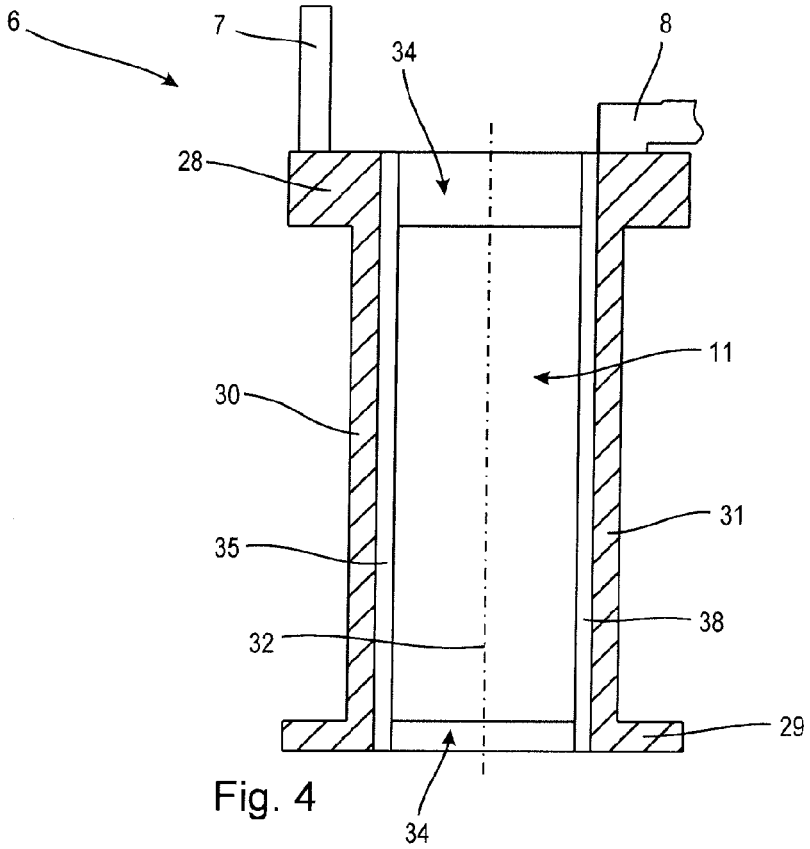
FIG. 4 is a lateral sectional view of the coil body according to FIG. 3.
Figure 6:
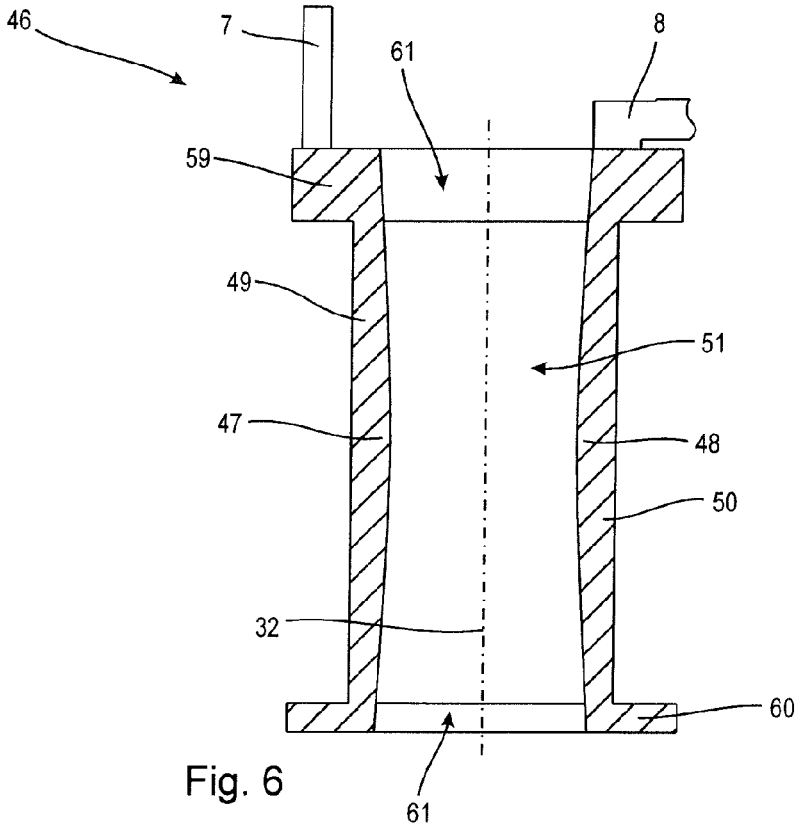
FIG. 6 shows a second embodiment of a coil body with a profile having a cross-section which varies along the winding axis.

Each of the wire coils 2, 3 has a plurality of windings of a coil wire not shown in detail, in particularly of a copper-enamelled wire, which windings are accommodated on a coil body 6, as shown in different embodiments in FIGS. 3, 4 and 6. One of the purposes of the coil body 6 is the support of the respective wire coil 2, 3. The coil body 6 further serves to maintain a minimum distance between the coil core made of an electrically conductive material, in particular iron, and the windings of the respective wire coil 2, 3, which are not shown in detail. In addition, the coil body 6 is provided with metallic connecting pins 7 and metallic connecting bridges 8, which are provided for an electric coupling of the wire coils 2, 3. To provide an electric insulation for the connecting pieces 7 and the connecting bridges 8, the coil body 6 is preferably produced from an electrically insulating material, in particular plastic. It is particularly preferred if the coil body 6 is produced in a plastic injection moulding process, wherein it may in particular be provided that the connecting pieces 7 and the connecting bridges 8 are placed in a plastic injection mould prior to the production of the coil body 6 and covered with the plastic material of the coil body 6, in order to avoid a separate assembly of these components.

By way of example, the coil core 4 according to FIG. 1 is designed in one piece and has in the U-legs 9, which project downwards according to the representation of FIG. 1 and which pass through the wire coils 2, 3, recesses 10, which correspond to profiles provided on the coil bodies 6 and are to be described at a later point and which are shown in greater detail in FIG. 5 in particular.

Figure 2:
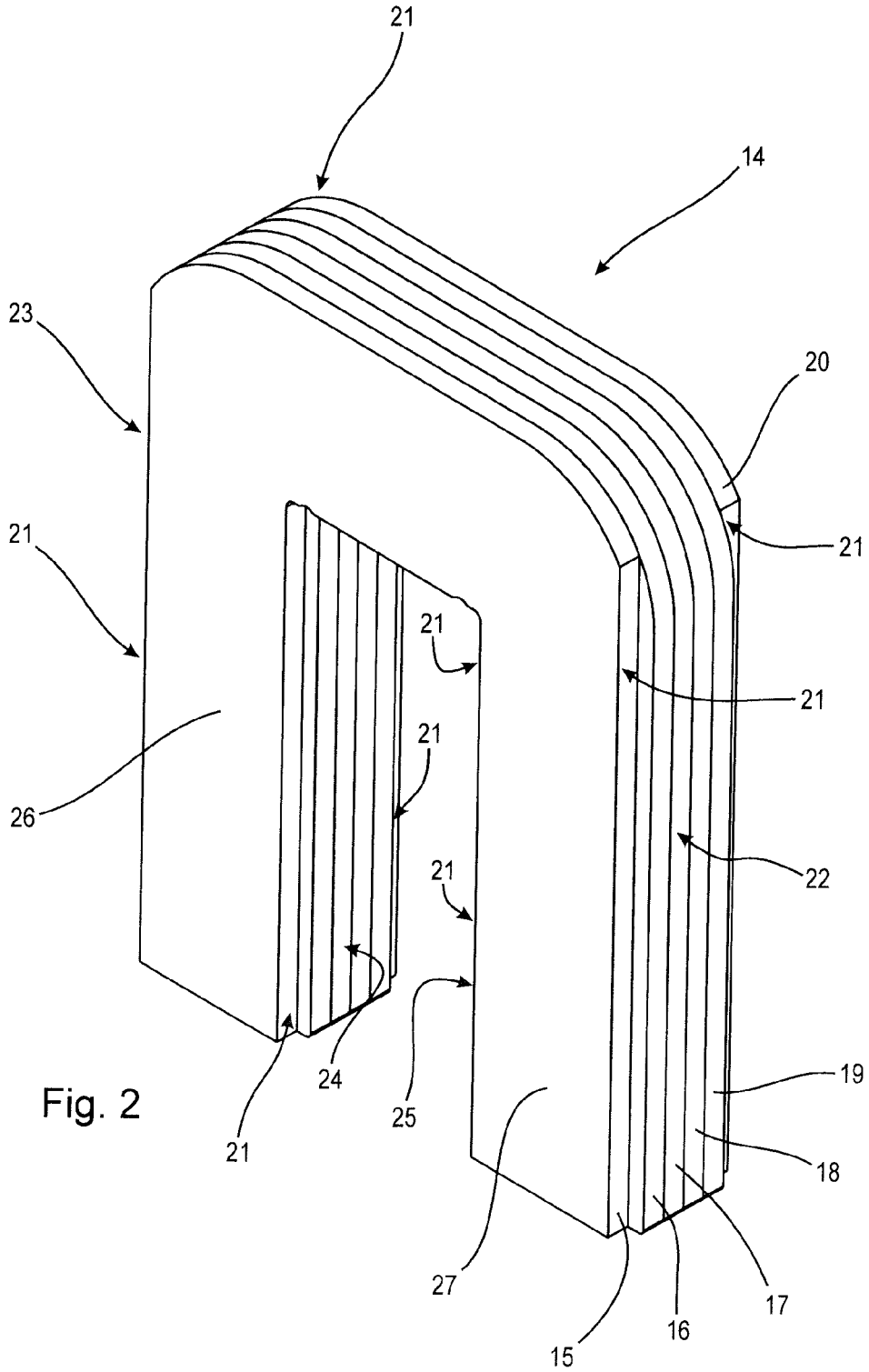
FIG. 2 shows an embodiment of a coil core formed from a plurality of mutually parallel sheet metal layers.

The coil core 14 according to FIG. 2 does not differ from the single-piece coil core 4 according to FIG. 1 in its envelope geometry, but is made up from a plurality of parallel sheet metal layers 15 to 20, which may, for example, be joined to one another by adhesive force. In the illustrated embodiment, the sheet metal layers 15 to 20 are provided with an insulating coating not shown in detail at their largest surfaces and bonded to one another or joined in another way by adhesive force. The coil core 14 can be used as an alternative to the coil core 4 for the accommodation of the wire coils 2, 3 and accordingly has recesses 21 both at the outer end faces 22, 23 and at the inner end faces 24, 25 of the U-legs 26, 27. In the illustrated embodiment, the recesses 21 are formed by giving the respective outer sheet metal layers 15 and 20 a smaller cross-section than the other sheet metal layers 16, 17, 18 and 19, so that the recesses 21 are formed as offsets between the sheet metal layers 15 and 20 and the other sheet metal layers 16, 17, 18 and 19.

In the first embodiment of the core body shown in FIGS. 3 and 4 and known from FIG. 1, the wire coil not shown in FIG. 3 is accommodated between two end pieces 28, 29 designed as plane-parallel plates with a substantially rectangular cross-section in the illustrated embodiment. The end pieces 28, 29 are oriented parallel to one another and joined to one another by two connecting webs 30, 31. In the illustrated embodiment, a recess 34 co-defining the accommodating space 11 and cuboid in the illustrated embodiment passes through each of the end pieces 28, 29.

In a cross-sectional plane which is not shown and which is oriented normal to the winding axis 32, the end pieces 28, 29 have the cross-section indicated by broken lines on the connecting web 31. The connecting webs 30, 31 are, for example, designed as plane-parallel plates with corners 33 rounded radially relative to the winding axis 32 at an outward-oriented surface, to facilitate an advantageous redirection of the windings of the wire coil around the respective connecting webs 30, 31. On an inside of the connecting webs 30, 31, there is further provided a recess 41 extending along the winding axis 32 and having a rectangular cross-section, which recess 41 extends across the entire width of the connecting webs 30, 31, so that profiles 35, 36, 37 and 38 are formed in outward edge regions of the connecting webs 30, 31. These profiles 35, 36, 37 and 38 on the one hand facilitate the strong rounding of the rounded edges 33. On the other hand, the profiles 35, 36, 37 and 38 engage with the recesses 10, 21 of the respective coil cores 4, 14 for an advantageous guidance between the respective coil core 4, 14 and the coil body during the assembly process, thus avoiding damage to the windings of the wire coils 2 and 3 respectively, which are mounted on the coil body 6.

Figure 5:
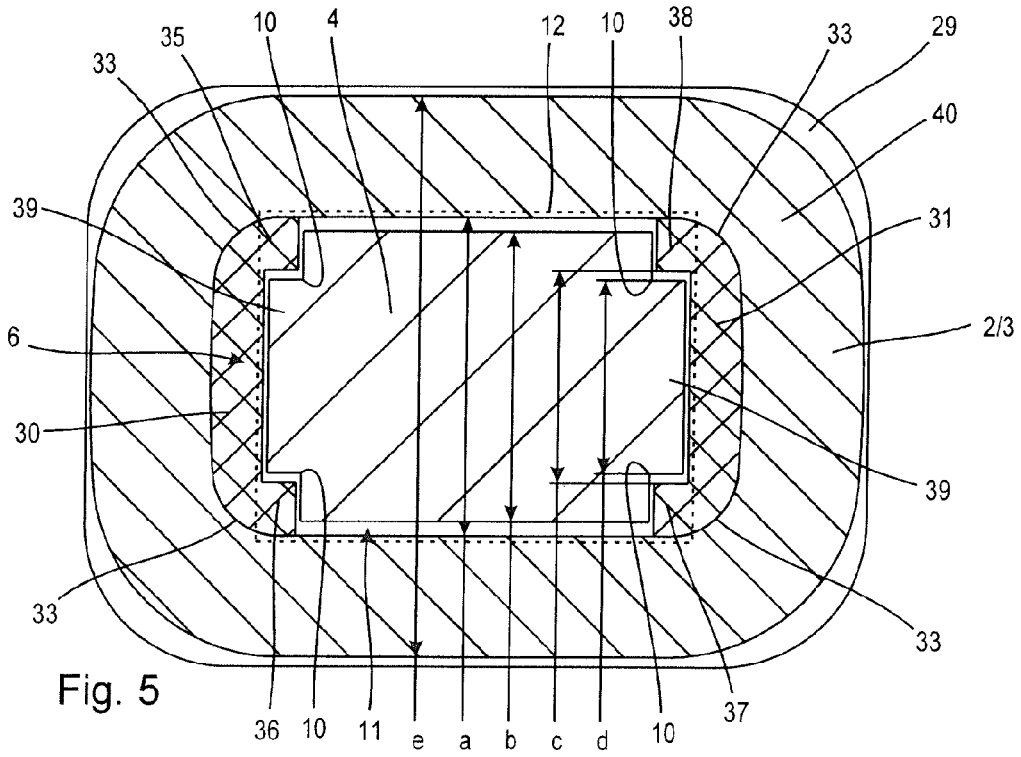
FIG. 5 is a sectional view of an electromagnet with the coil body according to FIGS. 3 and 4.

As can be seen in FIG. 5, a width dimension "a" of the connecting webs 30, 31 is chosen to be larger than a width dimension "b" of the coil core 4 or 14 respectively. Furthermore, a difference between a width dimension "c" of the recess 34 in the connecting webs 30, 31 and a width dimension "d" of a projection 39 on the coil core 4 or 14 respectively is chosen to be less than a difference of the width dimensions "a" and "b", so that a mechanical contact between the coil core 4 or 14 respectively and the windings 40 of the wire coils 2 or 3 respectively can be avoided owing to the guidance characteristics of the profiles 35, 36, 37 and 38 while the respective coil core 4 or 14 is being inserted into the coil body 6. By this design of the connecting webs 30, 31 and the coil core 4 or 14 respectively, an advantageous overall width can be obtained for the wire coils 2 or 3, so that in this spatial direction a plurality of wire coils 2 or 3 can be arranged adjacent to one another with a raster dimension which is as small as possible.

Figure 7:
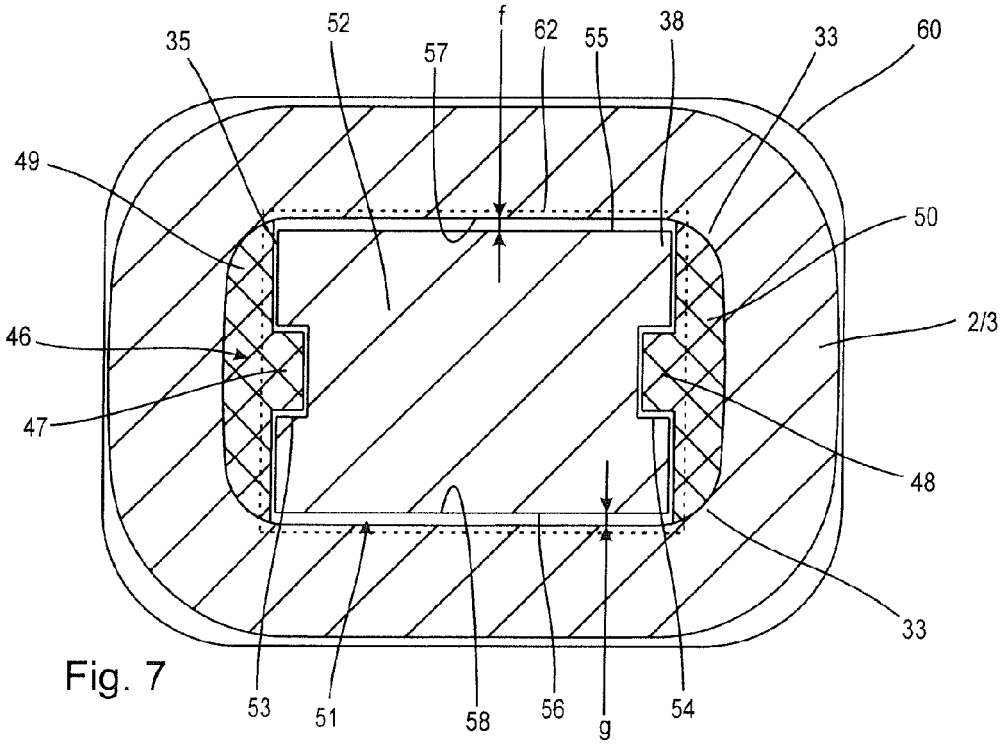
FIG. 7 shows a cross-section of an electromagnet with the coil body according to FIG. 6.

The coil body 46 shown in FIGS. 6 and 7 differs from the coil body 6 in that the profiles 47, 48 on the connecting webs 49, 50 are not located at the edges but rather in a central region of the respective connecting webs 49, 50. FIG. 6 further shows that the profiles 47, 48 have a variable profile height along the winding axis 32. In the illustrated embodiment, it is provided that the profiles 47, 48 are arcuate in the cross-sectional view of FIG. 6. In a central region of the coil body 46, the profiles 47, 48 project particularly far into the accommodating space 51 provided for accommodating a suitably adapted coil core 52 according to FIG. 7. By these profiles 47, 48 and the corresponding, in particular geometrically similar, recesses 53, 54 on the coil core 52, a positive guidance is facilitated in a similar way as in the case of the coil body 6 and the associated coil cores 4, 14 between the coil body 46 and the coil core 52 during the assembly of these components. As a result, safety gaps f and g can be chosen between the outer surfaces 55, 56 of the coil core 52 and the inner surfaces 57, 58 of the wire coils 2 or 3 respectively in such a way that a narrow construction is obtained for the electromagnet.

In the illustrated embodiment, it is provided that end pieces 59, 60 of the coil body 46 are each provided with an in particular cuboid recess 61, which allows the coil core 52 to be inserted into the coil body 46. It is further provided by way of example that each of the profiles 47, 48 starts at the end pieces 59, 60, with certain sections of the recesses 61 defining the accommodating space 51, which is otherwise bounded by sections of the connecting webs 49, 50.

The illustrations of FIGS. 5 and 7 show that the cross-sections of the accommodating spaces 11, 51 formed by the respective coil bodies 6, 46 can in each case be described by a rectangular envelope 12 or 62 respectively, which is indicated by broken lines and drawn slightly enlarged for reasons of illustration and into which the profiles 35, 36, 37 and 38 or 47 and 48 respectively project. These figures further show that the coil cores 4 or 14 respectively and 52 likewise have a substantially rectangular cross-section which is locally changed only in order to accommodate the recesses 10, 53 required for accommodating the profiles 35, 36, 37 and 38 or 47 and 48 respectively.

Apart from guidance for the coil core 52 relative to the coil body 46, the profiles 47, 48 have the additional function of curving the coil body 46 outwards in the region of the profiles 47, 48 when it is placed on a cuboid winding mandrel of a coil winding machine not shown in detail. As a result, the wire coil wound with a predetermined tensile force experiences a relaxation at least in the central region of the coil body 46 after being removed from the winding mandrel, followed by a reduction of inward-directed deformation forces applied by the wire coils 2 or 3 respectively to the connecting webs 49, 50. This simplifies the assembly of the coil core 52 and may even prevent a collapse of the connecting webs 49, 50. Furthermore, the profiles 35, 36, 37 and 38 or 47 and 48 respectively reinforce the respective connecting webs 30, 31 or 49 and 50 respectively, so that a considerable stabilising action can be achieved without any major influence on the free cross-section of the accommodating space 11, 51.

In a variant of the coil body 6 not shown in the drawing, the profiles are implemented with varying cross-sections as in the case of the coil body 46.

The invention claimed is:

1. An electromagnet comprising at least one wire coil and at least one coil core, wherein the at least one wire coil is accommodated on a coil body and comprises a plurality of windings which surround the at least one coil core and define a winding axis, wherein the coil body comprises end pieces spaced apart along the winding axis and axially bounding the at least one wire coil, which end pieces are connected to each other by at least two connecting webs extending along the winding axis and defining, together with a recess in at least one of the end pieces, an accommodating space for the at least one coil core wherein the accommodating space is bounded by a rectangular envelope having at least one profile protruding inwards in a cross-sectional plane oriented perpendicular to the winding axis, and wherein the at least one coil core has a recess which extends along the winding axis in at least some sections and which corresponds to the profile.

2. The electromagnet according to claim 1, wherein the profile is formed on a surface of the connecting web which is opposite the at least one coil core.

3. The electromagnet according to claim 1, wherein the profile is formed on a surface of the recess of the end piece which lies opposite the at least one coil core.

4. The electromagnet according to claim 1, wherein two connecting webs, which form opposite side surfaces of the accommodating space, are located between the end pieces.

5. The electromagnet according to claim 4, wherein each connecting web comprises two edge regions which extend along the winding axis, each of which is provided with a profile and located in corner regions of the envelope.

6. The electromagnet according to claim 1, wherein at least one profile has a cross-section which varies along the winding axis.

7. The electromagnet according to claim 1, wherein the at least one coil core is formed from a plurality of mutually parallel sheet metal layers, and wherein the recesses are designed as recesses or offsets on the sheet metal layers.

* * * * *